US005244019A

United States Patent [19]

Derby

[11] Patent Number: 5,244,019

[45] Date of Patent: Sep. 14, 1993

[54] VACUUM FILL SYSTEM

[75] Inventor: Norwin C. Derby, Dallas, Tex.

[73] Assignee: Better Agricultural Goals Corp., Dallas, Tex.

[21] Appl. No.: 932,581

[22] Filed: Aug. 20, 1992

Related U.S. Application Data

[63] Continuation-in-part of Ser. No. 643,704, Jan. 22, 1991, abandoned, which is a continuation of Ser. No. 407,901, Sep. 15, 1989, abandoned.

[51] Int. Cl.[5] ..... B65B 1/26

[52] U.S. Cl. ..... 141/65; 141/68; 141/71; 141/314; 414/220; 222/152; 222/368; 222/452; 222/636

[58] Field of Search ..... 222/152, 216, 252, 367, 222/368, 442, 450, 452, 636, 637; 414/217, 219-221; 141/65, 67, 68, 71, 73, 80, 5, 8, 10-12, 98, 114, 313-317

[56] References Cited

U.S. PATENT DOCUMENTS

| | | | |
|---|---|---|---|
| 1,696,952 | 1/1929 | Hartman | 141/315 |
| 1,723,211 | 8/1929 | Schmidt | 222/367 |
| 2,138,356 | 11/1938 | Ryan et al. . | |
| 2,142,990 | 1/1939 | Belcher . | |
| 2,599,978 | 6/1952 | Davis et al. | 222/368 |
| 2,720,375 | 10/1955 | Carter . | |
| 2,780,247 | 2/1957 | Claassen | 141/7 |
| 2,783,786 | 3/1957 | Carter | 141/51 |
| 2,815,621 | 12/1957 | Carter . | |
| 2,907,499 | 10/1959 | Agronin | 222/636 X |
| 2,964,070 | 12/1960 | Linhardt | 141/7 |
| 3,063,477 | 11/1962 | Vogt | 141/5 |
| 3,258,041 | 6/1966 | Lau | 141/10 |
| 3,260,285 | 7/1966 | Vogt | 141/8 |
| 3,542,091 | 11/1970 | Carter | 141/65 |
| 3,586,066 | 6/1971 | Brown | 141/5 |
| 3,589,411 | 6/1971 | Vogt | 141/71 |
| 3,605,826 | 9/1971 | Carter | 141/5 |
| 3,612,307 | 10/1971 | Vogt | 414/220 |
| 3,785,410 | 1/1974 | Carter | 141/10 |
| 3,788,368 | 1/1974 | Geng et al. | 141/67 |
| 3,847,191 | 11/1974 | Aronson | 141/12 |
| 4,182,386 | 1/1980 | Alack | 141/83 |
| 4,185,669 | 1/1980 | Jevakohoff | 141/59 |
| 4,219,054 | 8/1980 | Carter et al. | 141/10 |
| 4,244,705 | 1/1981 | Seidl et al. | 414/219 X |
| 4,397,657 | 8/1983 | Selep et al. | 414/220 X |
| 4,457,125 | 7/1984 | Fishburne | 141/80 X |
| 4,526,214 | 7/1985 | McGregor | 141/59 |
| 4,545,410 | 10/1985 | Paul et al. | 141/18 |
| 4,573,504 | 3/1986 | Rosenstrom | 141/59 |
| 4,614,213 | 9/1986 | Englin | 141/59 |
| 4,648,432 | 3/1987 | Mechalas | 141/68 |
| 4,854,353 | 8/1989 | Russell | 141/74 |
| 5,109,893 | 5/1992 | Derby | 141/67 |

FOREIGN PATENT DOCUMENTS

| | | | |
|---|---|---|---|
| 1265286 | 5/1961 | France | 141/10 |

*Primary Examiner*—Henry J. Recla
*Assistant Examiner*—Casey Jacyna
*Attorney, Agent, or Firm*—Michael A. O'Neil

[57] ABSTRACT

A vacuum fill system for continuously deaerating and compacting flowable materials for transportation and storage in containers includes a first rotatable chamber valve for receiving the flowable materials. Attached to the rotatable chamber valve is a fixed position chamber connected to a vacuum source for receiving the flowable materials from the first rotatable chamber and for deaerating the flowable materials. The fixed position chamber is in turn connected to a second rotatable chamber valve for receiving the deaerated flowable materials from the fixed position chamber, maintaining the materials in a vacuum, then returning the materials to atmospheric pressure substantially instantaneously as the valve rotates to compact the deaerated materials into a substantially solid mass. A compressed air source is connected to the second rotatable chamber valve for injecting compressed air into the valve to force the substantially solid mass of compacted deaerated materials into a container positioned adjacent thereto.

20 Claims, 9 Drawing Sheets

VACUUM FILL SYSTEM

RELATED APPLICATION

This Application is a continuation-in-part of co-pending U.S. application Ser. No. 07/643,704, filed Jan. 22, 1991 now abandoned, which is a file-wrapper continuation of application Ser. No. 07/407,901, filed Sep. 15, 1989, now abandoned. This application is further related to co-pending U.S. application Ser. No. 07/615,293, filed Nov. 19, 1990 now U.S. Pat. No. 5,109,893, also a continuation-in-part of application Ser. No. 07/407,901, now abandoned.

TECHNICAL FIELD

This invention relates to a vacuum fill system for deaerating flowable materials for storage in a container, and in particular, to a vacuum fill system for continuously deaerating and compacting flowable materials to be placed in a container.

BACKGROUND OF THE INVENTION

Containers used in the storage, transportation, and dispensation of flowable materials have been around for as long as civilization itself. The use of such containers, however, has always been limited by (1) the weight, density, and other physical properties of the material being stored, and (2) by the process and type of container used to store the material.

Traditional filling processes and containers have long been encumbered by a simple phenomenon that has exasperated consumers for decades—settling. Settling, as any purchaser of a bag of potato chips knows, means the bag is never completely filled when opened. This occurs due to the settling of the product inside during its filling and shipment. This simple settling phenomenon causes tremendous economic waste each year because of the misuse of storage space and container materials. This has been particularly true in the storage, transportation, and dispensation of flowable materials in semi-bulk quantities such as grains, chemicals and other bulky substances stored in flexible, bulk containers, such as those disclosed in U.S. Pat. Nos. 4,143,796 and 4,194,652.

It has long been known that the settling process is caused by the natural aeration of flowable materials as the materials are placed inside a container. As the container is shipped to its final destination, the air escapes from the aerated material mixture causing the product to compact and reduce in volume. Thus, when the container is opened, the flowable material has settled to the bottom of the container, i.e. the bag of potato chips is only half full.

Any process or system, such as the present invention, for storing materials in a container for shipment that allows all of the container to be filled with product and eliminates the excess air results in an enormous cost savings. Indeed, the shipment of smaller sized containers using vacuum sealed packages such as, e.g., vacuum sealed coffee containers, has alleviated many of the above problems of cost and time.

Although vacuum sealed packaging has proved to be an efficient, cost-saving and consumer pleasing method of shipping small quantities of goods, before now, it has been impossible to apply such techniques into other areas of storage, transportation and dispensation of flowable materials. This has been particularly true in the market for semi-bulk flowable materials.

The present invention, however, substantially eliminates settling and the inherent problems associated therewith by providing a vacuum filling system that deaerates the flowable material during filling. The present invention thus allows more product to be transported in the same size container than is possible using prior techniques.

Additionally, by utilizing all of the container space, the present invention allows for the far more efficient total use of all of the container materials and space. No longer is money being spent for container material that is not used. Therefore, the present invention overcomes many of the difficulties inherent in prior filling systems.

SUMMARY OF THE INVENTION

The present invention relates to a vacuum filling system for deaerating flowable materials, and particular, to a vacuum system for continuously deaerating and compacting flowable materials during the filling process. The vacuum filling system is used to fill all types of bulk containers, including tank trucks, rail cars, shipping containers, and flexible bulk containers used to store, transport, and dispense flowable materials in semi-bulk quantities.

The vacuum fill system of the present invention generally comprises a first rotatable, air tight chamber valve for receiving the loose flowable material. The first chamber valve is attached to a hollow, fixed position chamber connected to a vacuum source. As the first rotatable chamber rotates, the flowable material received therein is deposited into the connected fixed position chamber. A vacuum is created in the fixed position chamber to deaerate the flowable materials.

Connected to the fixed position chamber is a second rotatable, air tight chamber valve. The second chamber valve is connected through a plurality of openings in the chamber housing to the vacuum source, to the atmosphere, and to a compressed air source. As the second rotatable chamber valve rotates, an opening in the chamber communicates with the opening in the chamber housing connected to the vacuum, thereby creating a vacuum within the chamber. As rotation continues, the flowable materials fall from the fixed position chamber into the second rotatable chamber valve. As the chamber valve continues to rotate, the opening in the chamber communicates with the opening in the housing connected to the atmosphere to substantially instantaneously return the pressure in the chamber to atmospheric pressure to compact the deaerated material.

Continued rotation of the valve brings the opening in the chamber into alignment with the opening in the housing connected to the compressed air source, thereby injecting compressed air into the chamber to force the compacted material therefrom. The compacted material then falls into a flexible bulk container suspended below the second rotatable chamber valve. The rotation of the first and second rotatable chamber valves is continuous allowing for a continual process of deaeration and compaction of the flowable material.

By deaerating and compacting the flowable material before filling the container, through the use of the vacuum fill system, the flowable material is pre-settled and will not settle during shipment. Thus, the present invention allows for complete utilization of the storage container, eliminating wasted space, and allowing for the shipment of more material without any increase in the container volume. Furthermore, the continuous operation of the vacuum fill system allows rapid filling of the container. Therefore, the present invention has numerous advantages over the prior art.

BRIEF DESCRIPTION OF THE DRAWINGS

A more complete understanding of the invention may be had by reference to the following Detailed Description when taken in conjunction with the accompanying Drawings, in which.

DETAILED DESCRIPTION OF THE DRAWINGS

Figure 1:
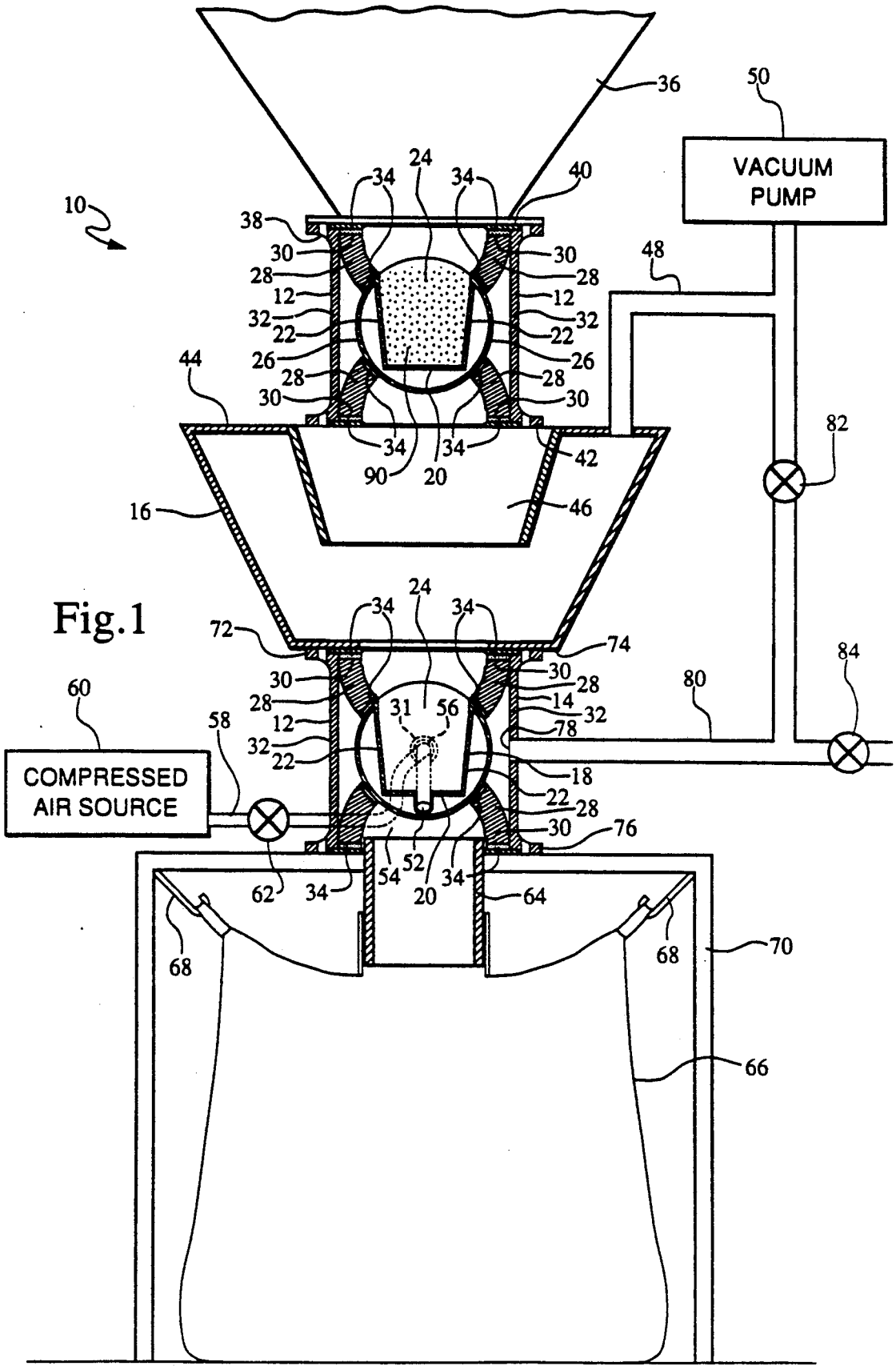
FIG. 1 is a partial sectional view of the vacuum fill system incorporating a first embodiment of the present invention.

Referring now to the Drawings, and in particular to FIG. 1, there is shown a vacuum fill system 10 having a first rotatable chamber valve 12, a second rotatable chamber valve 14, and a fixed position, hollow, tapered chamber 16 mounted therebetween. In the preferred embodiment of the invention, the rotatable chamber valves are rotor airlock valves. Although any commercially available airtight rotor valve would be suitable, the rotor airlock valves are preferably of the type manufactured by Sigco Valve Company and sold as the Sigco B-Series Airlock Valve.

Figure 2:
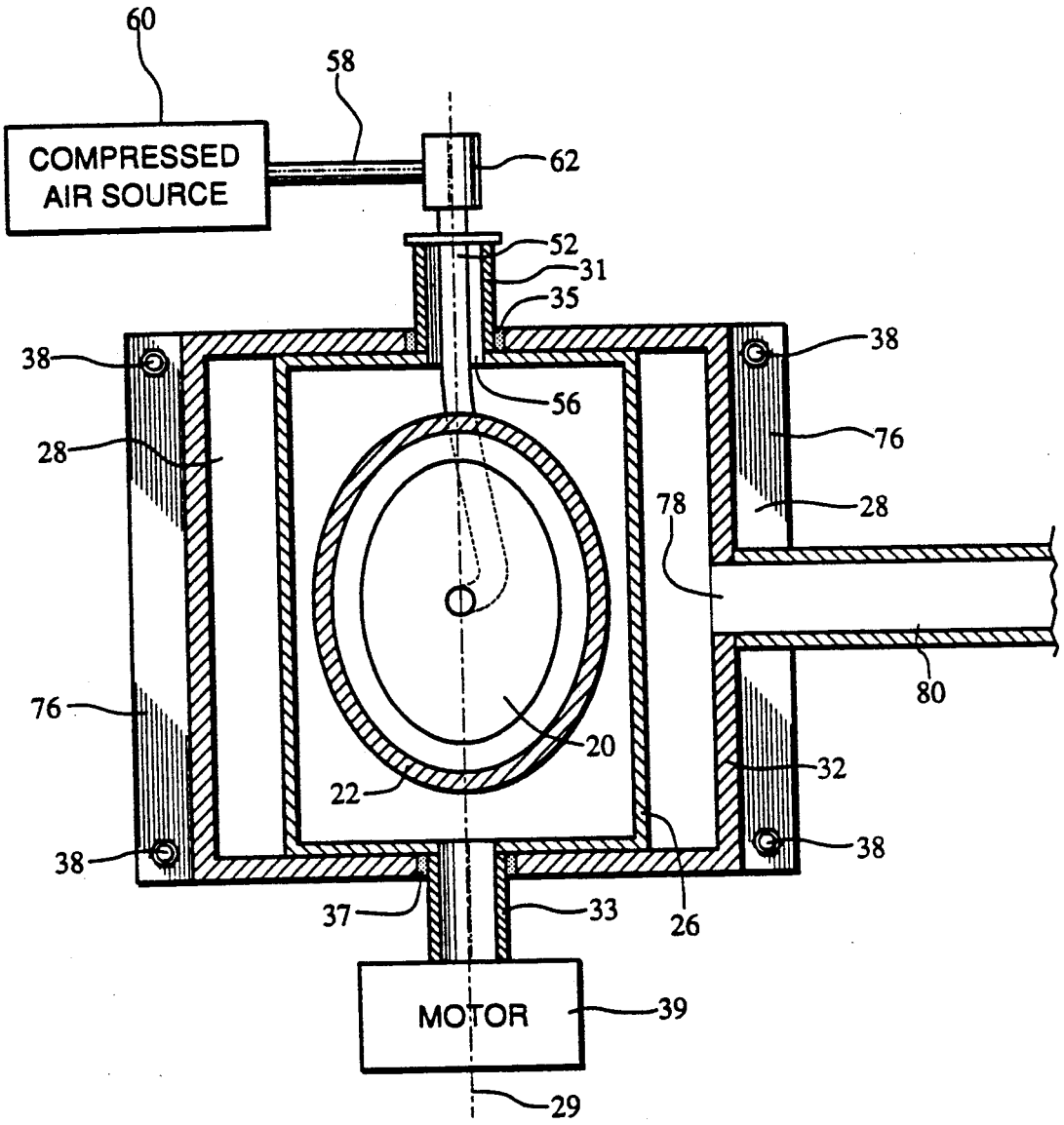
FIG. 2 is a top sectional view of the second chamber valve of the vacuum fill system of FIG. 1.
Figure 7:
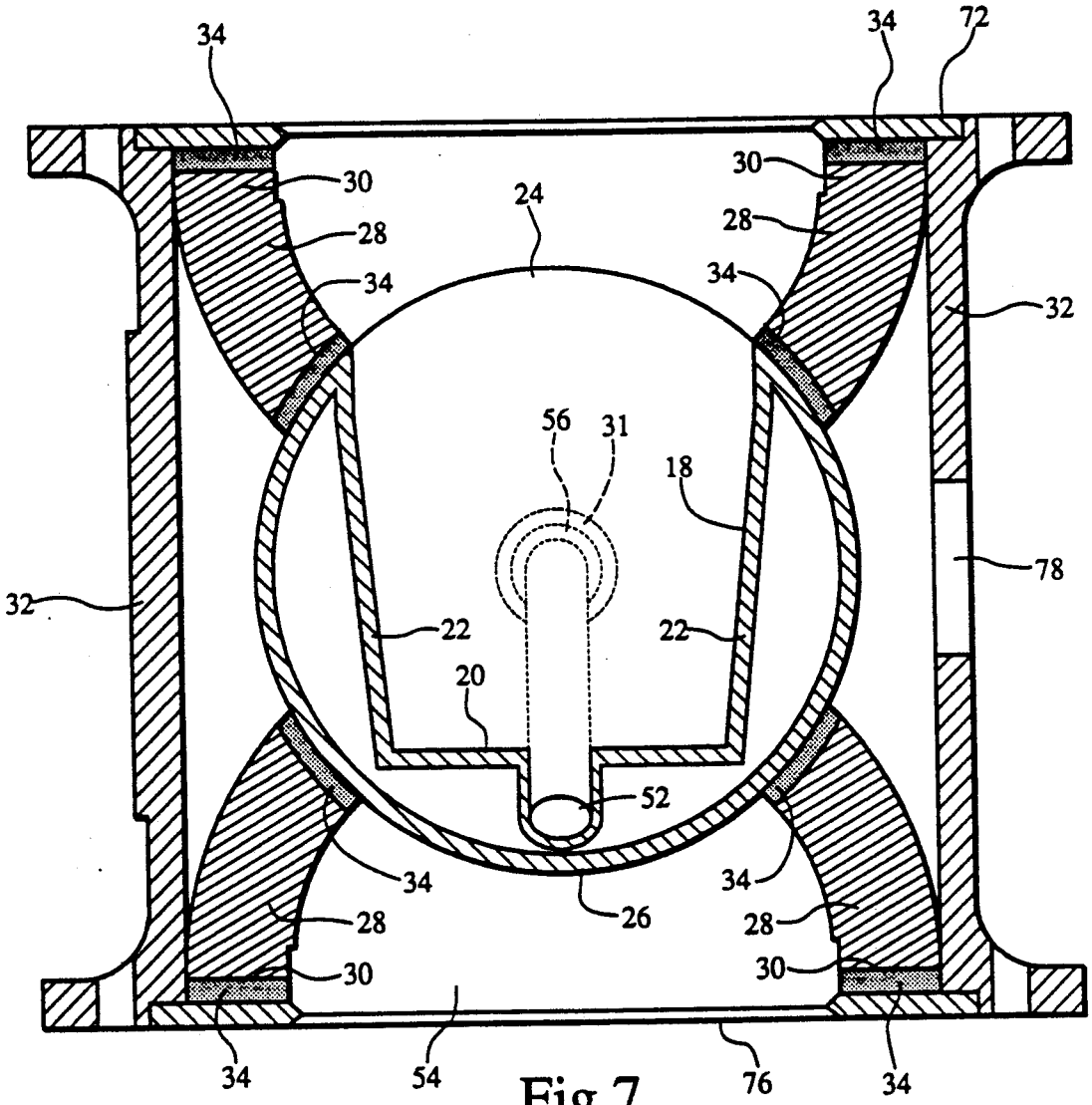
FIG. 7 is a front sectional view of a rotatable chamber valve of a vacuum fill system incorporating the present invention.

Referring now to FIGS. 1, 2 and 7, in the preferred embodiment of the invention, the rotatable chamber valves 12 and 14 have mounted therein an interior chamber wall 18 having a bottom wall 20 and two sidewalls 22 defining a bucket shaped chamber 24 for receiving flowable materials therein. The interior chamber wall 18 is surrounded by an exterior valve wall 26 such that one end of the bucket shaped chamber 24 remains open for receiving flowable materials therein.

The exterior valve wall 26 rotates between support arms 28 along an axis 29. Each support arm 28 is attached at its distal end 30 to a valve housing 32. On each end of the support arms 28 are seal strips 34 creating an airtight seal between the support arms 28 and the housing 32 and between the support arms 28 and the exterior valve wall 26. Shafts 31 and 33 extend outwardly from the exterior valve wall 26 through sealed openings 35 and 37 in the housing 32 for supporting the exterior valve wall 26 for rotation along the axis 29. A motor 39 provides power for driving the shaft 33 to rotate the exterior valve wall 26.

Referring still to FIG. 1, although any number of delivery methods may be used, in the preferred embodiment of the invention a hopper 36 is attached to a first end 40 of the housing 32 with conventional fasteners 38, for receiving flowable materials into the bucket area 24 of the first rotatable valve 12. A second end 42 of the housing 32 of the valve 12 is attached with conventional fasteners 38 to a first end 44 of the fixed position chamber 16.

The housing 32 of the first rotatable valve 12 is open at the first end 40 between the support arms 28 to allow flowable materials to pass from the hopper 36 into the bucket area 24 of the rotatable valve 12. Likewise, the second end 42 of the housing 32 of the first rotatable valve 12 is open between the support arms 28 to allow passage of the flowable materials from the bucket area 24 into the fixed position chamber 16 upon rotation of the exterior valve wall 26 between the support arms 28.

A baffle 46 extends from the first end 44 of the fixed position chamber 16 to regulate the flow of the material from the first rotatable valve 12 into the fixed position chamber 16 and to control the flow of dust from the chamber 16. Connected to the fixed position chamber 16 is a vacuum line 48 in turn connected to a vacuum pump 50. As the first rotatable chamber valve 12 rotates to discharge flowable material into the fixed position chamber 16, the vacuum pump 50 is actuated to create a vacuum in the chamber 16 to deaerate the flowable material.

Referring to FIGS. 1 and 7, the second rotatable valve 14 is connected at a first end 72 of the housing 32 to a second end 74 of the fixed position chamber 16 with conventional fasteners 38. Likewise, the second end 76 of the housing 32 of the second rotatable valve 14 is attached to the support frame 70 with conventional fasteners 38.

Figure 3:
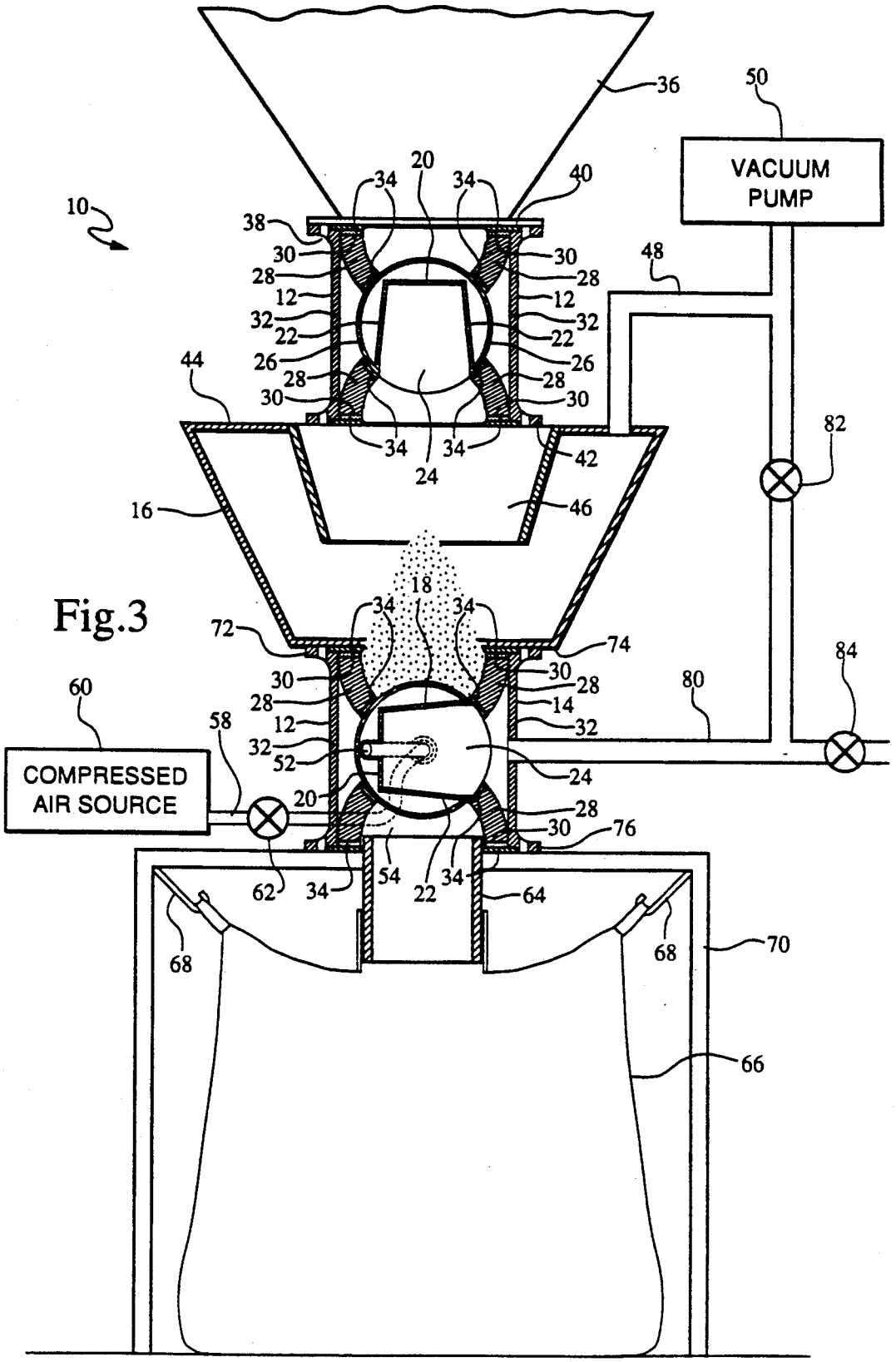
FIG. 3 is a view similar to FIG. 1 illustrating rotation of a first chamber valve and movement of the flowable material from the first valve into a hollow, fixed position chamber.
Figure 5:
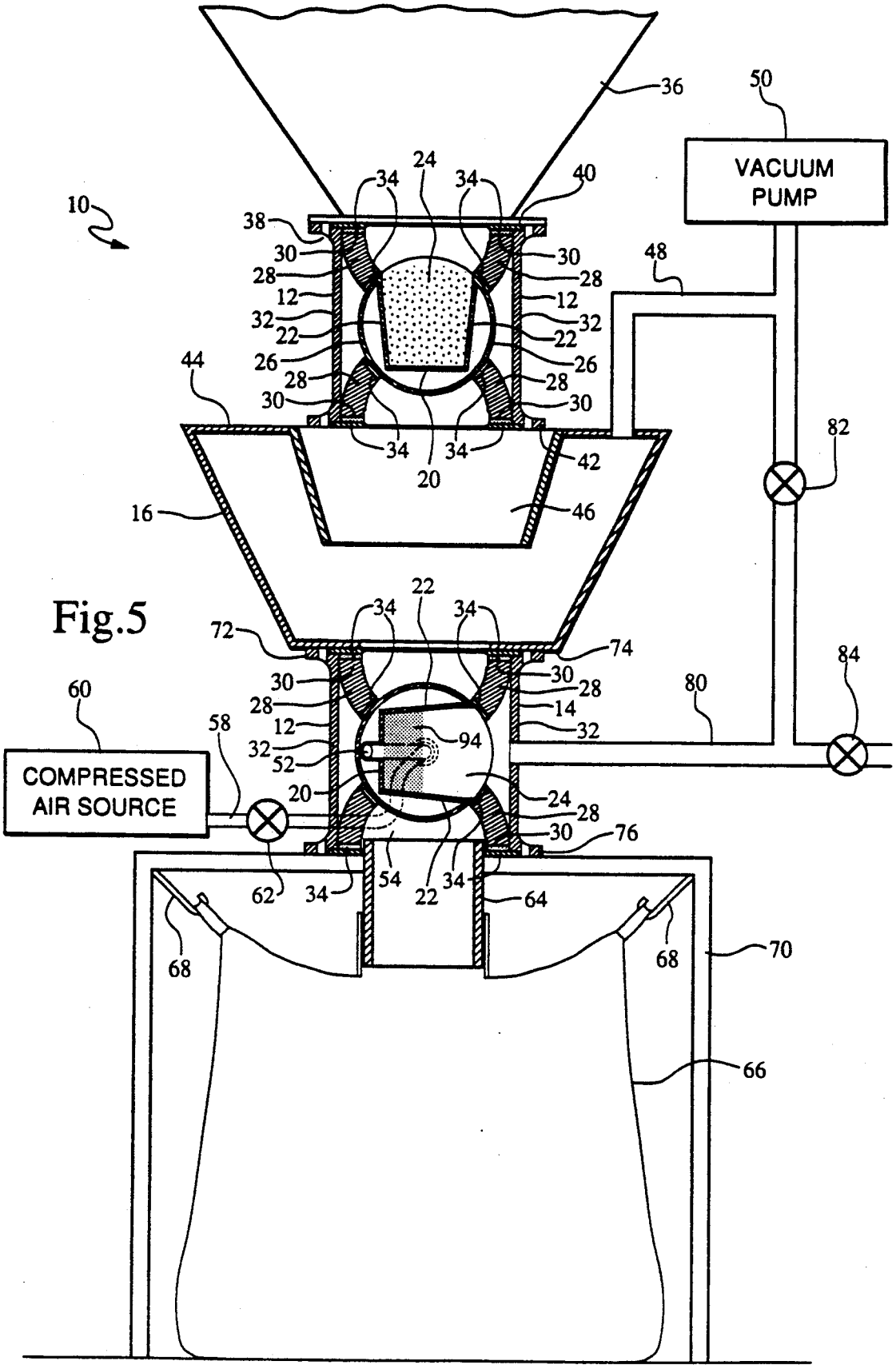
FIG. 5 is a view similar to FIG. 1 illustrating rotation of the second chamber valve for communication with atmospheric pressure.

Referring to FIGS. 3, 5, and 7, an opening 78 in the interior wall 54 of the housing 32 of the second rotatable valve 14 is connected through a vacuum line 80 to the vacuum pump 50 and to the atmosphere. A valve 82 in the line 80 between the vacuum pump 50 and the opening 78 is opened to maintain a vacuum in the bucket shaped chamber 24 when the valve 14 is rotated such that the open end of the bucket shaped chamber 24 is in alignment with the opening 78, as shown in FIG. 3. By closing valve 82 and opening valve 84 in vacuum line 80 the contents of the bucket shaped chamber 24 are returned to atmospheric pressure substantially instantaneously when the chamber is positioned as shown in FIG. 5.

Figure 6:
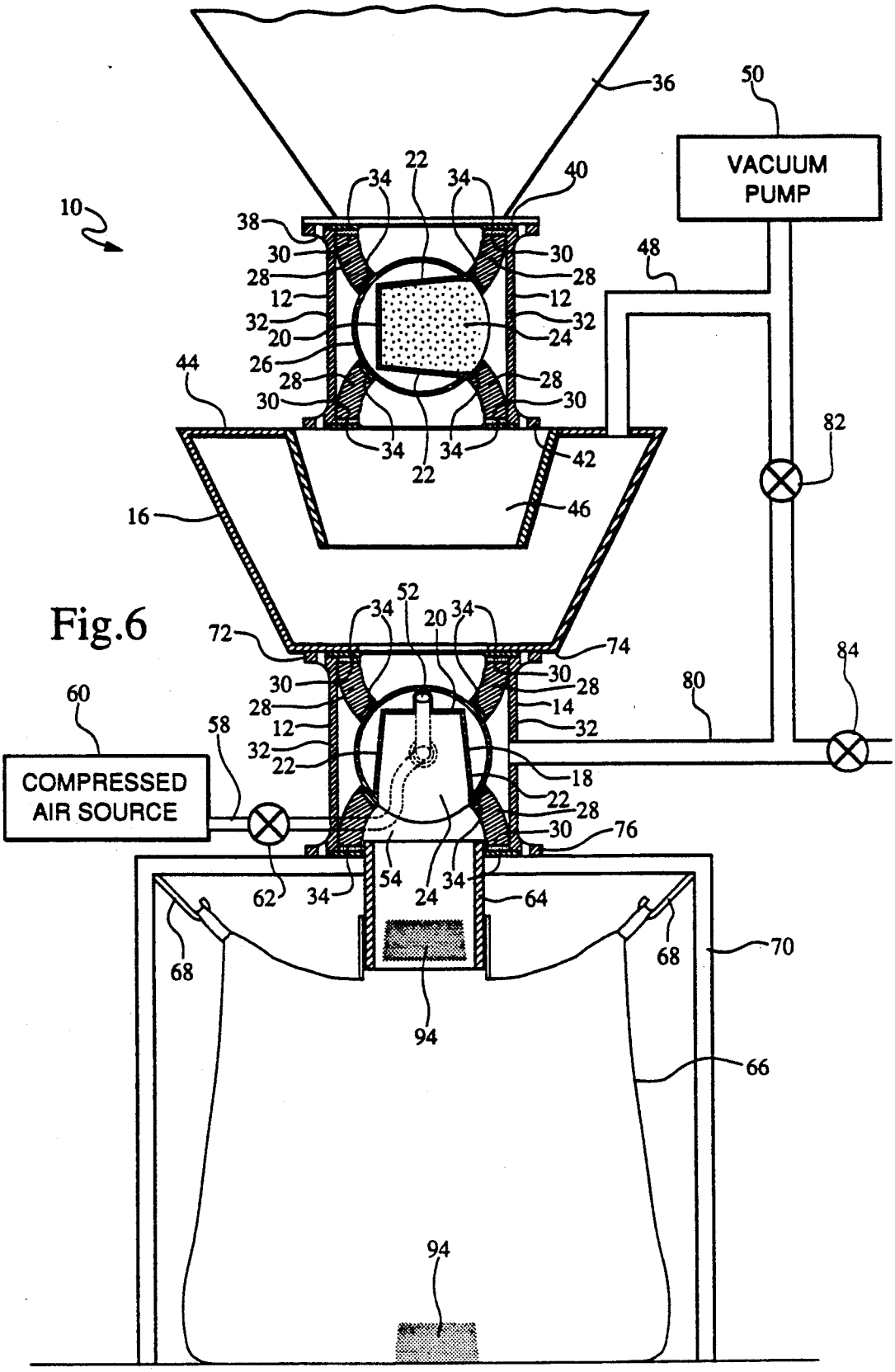
FIG. 6 is a view similar to FIG. 1 illustrating the discharge of compacted material from the second rotatable chamber.

Referring now to FIGS. 1, 6, and 7, the second rotatable chamber valve 14 has a flexible line 52 extending from the bottom wall 20 of the interior chamber wall 18 to an opening 56 in the interior wall 54 of the housing 32 of the second rotatable valve 14. The flexible line 52 passes through the shaft 31 and is connected through a rotating valve 62 to an air line 58 to a compressed air source 60. The valve 62 controls the flow of compressed air through the lines 58 and 52 into the interior of the second rotatable chamber valve 14 to discharge the compacted material from the bucket shaped chamber 24 as shown in FIG. 6. The compacted material falls from the chamber 24 through a discharge spout 64, and into a flexible bulk container 66 suspended on hooks 68 of a support frame 70 mounted beneath the second rotatable valve 14. Although, for purposes of illustration, the vacuum fill system 10 is shown filling a flexible bulk container, it is understood that the vacuum fill system 10 can be used to fill any type of container for receiving flowable materials therein.

Referring again to FIG. 1, when the vacuum fill system 10 is placed in operation the first rotatable valve 12 is positioned as shown in FIG. 1. Flowable material 90 is received from the hopper 36, or some other means of delivery, into the bucket shaped chamber 24 of the first rotatable valve 12. At this time, the flowable material 90 is at atmospheric pressure. The first rotatable chamber 12 then rotates approximately 180° to the position shown in FIG. 3. At this point in the cycle, the flowable material 90 falls from the bucket shaped chamber 24 of the first rotatable valve 12 into the fixed position chamber 16 in which a vacuum is constantly maintained through the connection of chamber 16 through vacuum line 48 to the vacuum pump 50.

The air is removed from the flowable material in chamber 16 resulting in deaerated flowable material 92 with the particles slightly suspended. At the same time, the bucket shaped chamber 24 of the second rotatable valve 14 is positioned in alignment with the opening 78 in the interior wall 54 of the housing 32. Valve 82 is open and valve 84 is closed to maintain a vacuum in the bucket shaped chamber 24 of the second rotatable valve 14.

Figure 4:
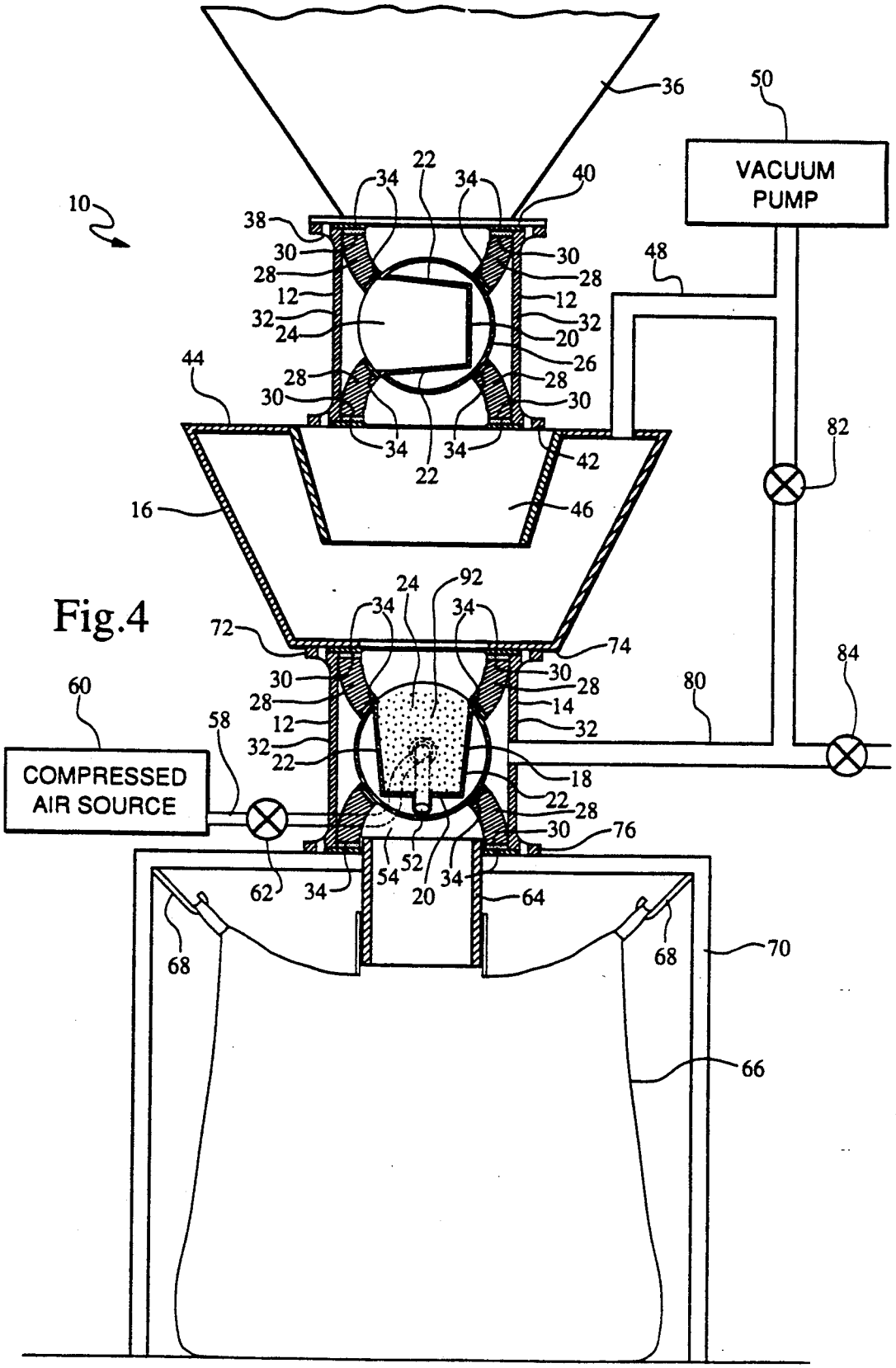
FIG. 4 is a view similar to FIG. 1 illustrating rotation of a second chamber valve to receive deaerated material from the fixed position chamber.

Referring now to FIG. 4, the first rotatable valve 12 and second rotatable valve 14 then rotate approximately 90° in opposite directions, with valve 12 rotating clockwise and valve 14 rotating counter-clockwise, to the positions shown in FIG. 4. Due to the vacuum maintained in the bucket shaped chamber 24 of the second rotatable chamber valve 14, the deaerated flowable material 92 falls into the bucket shaped chamber 24 of the second rotatable valve 14 and is maintained in a deaerated, suspended state.

Referring now to FIGS. 4 and 5, the first rotatable valve 12 and the second rotatable valve 14 then rotate approximately 90° in the same clockwise direction to the positions shown in FIG. 5. At this point, valve 82 is closed and valve 84 opened returning the bucket shaped chamber 24 to atmospheric pressure substantially instantaneously to compact the deaerated flowable material 92 into a near solid mass 94 occupying only a portion of the area previously occupied. Simultaneously, flowable material is again received from the hopper 36 into the bucket shaped chamber 24 of the first rotatable valve 12.

Referring now to FIG. 6, the first rotatable valve 12 and second rotatable valve 14 then rotated approximately 90° in the same direction to the positions shown in FIG. 6. At that point, the valve 62 in the air line 58 is opened, thereby injecting compressed air into the bucket shaped chamber 24 of the second rotatable valve 14 to force the substantially solid mass 94 of compacted, deaerated material from the bucket shaped chamber 24, through the discharge spout 64 and into the bulk container 66 suspended there below. The cycle is then repeated until the bulk container 66 is filled to a predetermined level with the compacted material.

Figure 8:
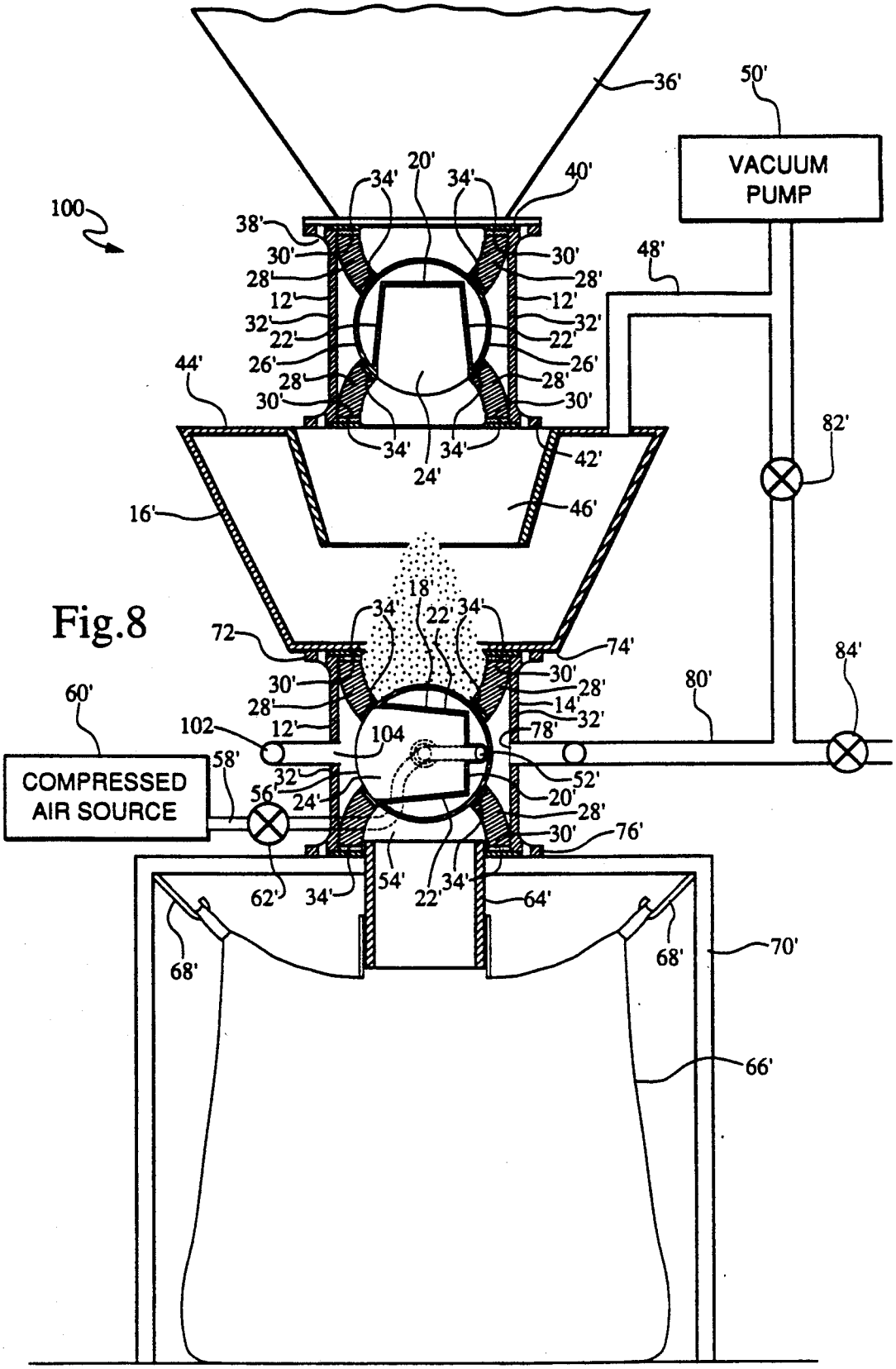
FIG. 8 is a partial sectional view of a vacuum fill system incorporating a second embodiment of the present invention.
Figure 9:
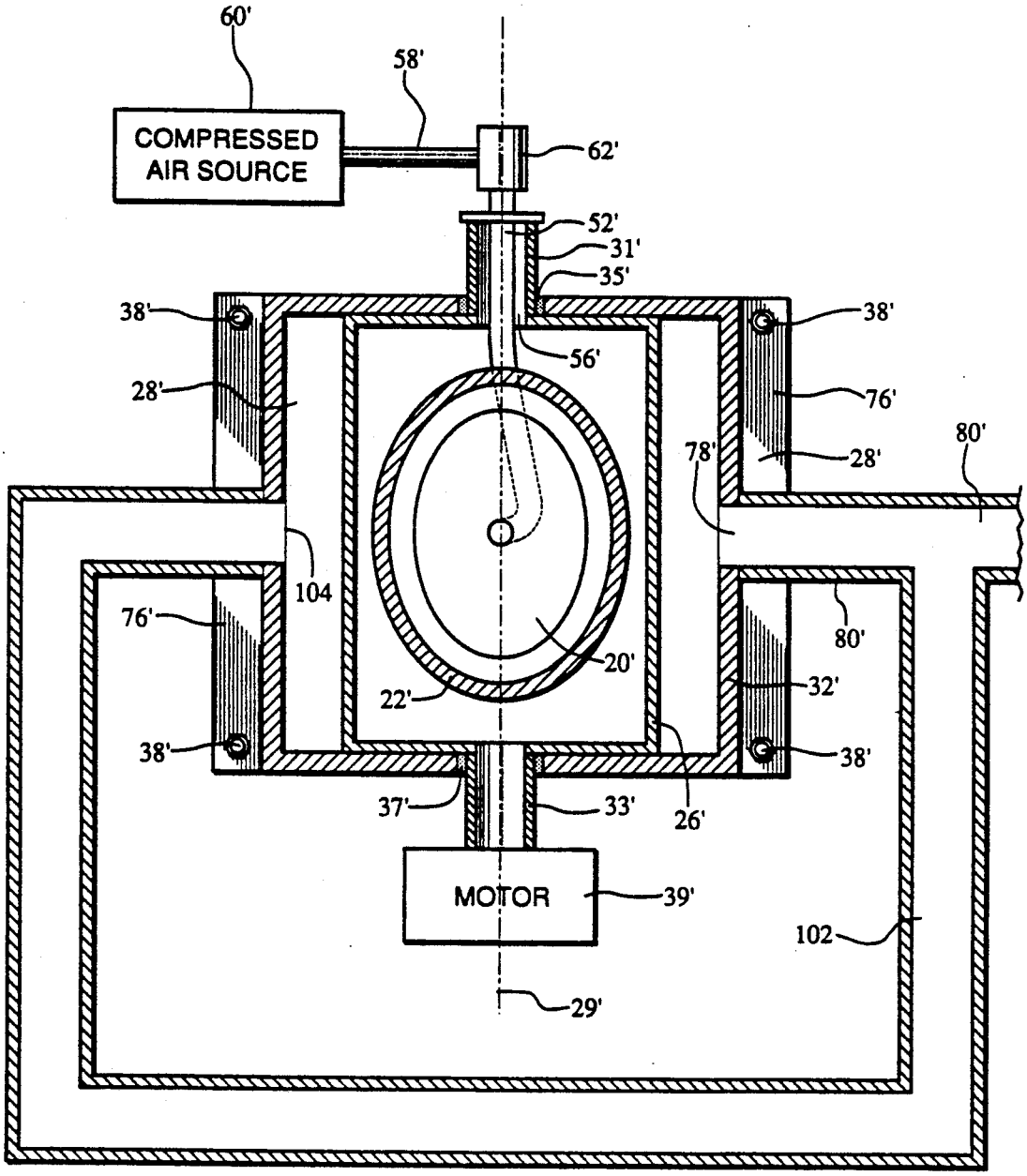
FIG. 9 is a top sectional view of the second chamber valve of the vacuum fill system of FIG. 8.

Referring now to FIGS. 8 and 9, there is shown a vacuum fill system 100 incorporating a second embodiment of the present invention. Many of the elements of the vacuum fill system 100 are similar to those of the vacuum fill system 10 of FIG. 1 and will be given the same reference numerals with the elements of the vacuum fill system 100 being differentiated by a prime "′" designation. To allow continuous rotation of the second chamber valve 14′, a second vacuum line 102 is connected between the vacuum line 80′ and an opening 104 in the interior wall 54′ of the housing 32 opposite the opening 78′. Therefore, in addition to a vacuum being created in the bucket shaped chamber 24′ of the second valve 14′ when in the position shown in FIG. 3, with reference to the first embodiment vacuum fill system, the vacuum may be created when the valve 14′ is rotated to the position wherein the open end of the bucket shaped chamber 24′ is aligned with the opening 104 in the housing 32′, as shown in FIG. 8. Thus, the valve 14′ and the valve 12′ both rotate in a clockwise direction through the cycle. Although the operation of the system has been described in a series of 90° rotations for descriptive purposes, in actual operation the rotation of the first rotatable valve 12 and 12′ and the second rotatable valve 14 and 14′ are substantially continuous allowing for very rapid deaeration and compaction, and thus, more rapid filling of the bulk container 66.

Although preferred embodiments of the present invention have been illustrated in the accompanying Drawings and described in the foregoing Detailed Description, it will be appreciated by those skilled in the art that various modifications and rearrangements of the component parts and elements of the present invention are possible within the scope of the present invention.

I claim:

1. A vacuum fill system for deaerating flowable materials comprising:

a first rotatable chamber for receiving flowable materials;

a fixed position hollow chamber connected to the first rotatable chamber for receiving flowable materials from the first rotatable chamber;

means for creating a vacuum in the fixed position chamber for deaerating the flowable materials; and a second rotatable chamber for receiving deaerated flowable materials from the fixed position chamber and for returning the deaerated materials to atmospheric pressure substantially instantaneously to compact the deaerated flowable materials into a near solid mass wherein a first end of the first rotatable chamber and a second end of the second rotatable chamber open to atmosphere.

2. The vacuum fill system for deaerating flowable materials of claim 1, further comprising means for creating a vacuum in the second rotatable chamber for maintaining the flowable materials in a deaerated state until returning the deaerated flowable materials to atmospheric pressure.

3. The vacuum fill system for deaerating flowable materials of claim 2, wherein the means for creating a vacuum in the second rotatable chamber further comprises at least one valve connecting a vacuum source to the second rotatable chamber.

4. The vacuum fill system for deaerating flowable materials of claim 1, further comprising means for forcing the compacted deaerated flowable materials from the second rotatable chamber into a receiving container.

5. The vacuum fill system for deaerating flowable materials of claim 4, wherein the means for forcing the compacted deaerated flowable materials from the second rotatable chamber into a receiving container further comprises at least one valve connecting a compressed air source to the second rotatable chamber.

6. The vacuum fill system for deaerating flowable materials of claim 1, wherein the first and second rotatable chambers comprise rotatable, airtight, chamber valves having first and second ends and an interior chamber wall defining an area wherein the flowable materials are received.

7. The vacuum fill system for deaerating flowable materials of claim 1, wherein a second end of the first rotatable chamber and a first end of the second rotatable chamber open into the fixed position hollow chamber.

8. The vacuum fill system for deaerating flowable materials of claim 1, further comprising a side opening in the second rotatable chamber connected to the means for creating a vacuum.

9. A vacuum fill system for deaerating flowable materials comprising:

a first rotatable chamber for receiving flowable materials;

a fixed position hollow chamber connected to the first rotatable chamber for receiving flowable materials from the first rotatable chamber;

means for creating a vacuum in the fixed position chamber for deaerating the flowable materials;

a second rotatable chamber for receiving the deaerated flowable materials from the fixed position hollow chamber;

means for creating a vacuum in the second rotatable chamber for maintaining the flowable materials in a deaerated state;

means for returning the second rotatable chamber to atmospheric pressure substantially instantaneously to compact the deaerated flowable materials; and means for forcing the compacted deaerated flowable materials from discharge end of the second rotatable chamber into a receiving container wherein the discharge end of the second rotatable chamber is open to atmosphere.

10. The vacuum fill system for deaerating flowable materials of claim 9, wherein the first and second rotatable chambers comprise rotatable, airtight, chamber valves having first and second ends and an interior chamber wall defining an area wherein the flowable materials are received.

11. The vacuum fill system for deaerating flowable materials of claim 10, further comprising an opening in the housing wall for communicating with the means for creating a vacuum in the second chamber and means for returning the second chamber to atmospheric pressure.

12. The vacuum fill system for deaerating flowable materials of claim 10, further comprising an opening in the interior chamber wall for communicating with the means for forcing the compacted material from the second rotatable chamber.

13. The vacuum fill system for deaerating flowable materials of claim 10, wherein the second end of the first rotatable chamber and the first end of the second rotatable chamber open into the fixed position hollow chamber.

14. The vacuum fill system for deaerating flowable materials of claim 9, wherein the fixed position hollow chamber further comprises a baffle for controlling the flow of the flowable materials into the fixed position chamber.

15. The vacuum fill system for deaerating flowable materials of claim 9, wherein the means for creating a vacuum in the second rotatable chamber further comprises at least one valve connecting a vacuum pump to the second rotatable chamber.

16. The vacuum fill system for deaerating flowable materials of claim 9, wherein the means for returning the second rotatable chamber to atmospheric pressure further comprises at least one valve connecting the second rotatable chamber to the atmosphere.

17. The vacuum fill system for deaerating flowable materials of claim 9, wherein the means for forcing the compacted deaerated flowable materials form the second rotatable chamber into a receiving container further comprises at least one valve connecting the second rotatable chamber to a compressed air source.

18. A vacuum fill system for continuously deaerating flowable materials comprising:

a first continuously rotatable airtight chamber valve for receiving flowable materials;

a fixed position hollow chamber connected to the first rotatable chamber for receiving flowable materials from the first rotatable chamber;

a vacuum source for creating a vacuum in the fixed position chamber for deaerating the flowable materials;

a second continuously rotating airtight chamber valve having an exterior housing and an interior chamber wall defining an area for receiving deaerated flowable materials from the fixed position hollow chamber;

a first opening in the housing of the second rotatable chamber and at least one valve connecting the vacuum source to the opening for creating a vacuum in the second rotatable chamber for maintaining the flowable materials in a deaerated state;

at least one valve connecting the first opening in the second rotatable chamber to the atmosphere for returning the deaerated flowable material to atmospheric pressure substantially instantaneously to compact the deaerated flowable material;

a second opening in the housing of the second rotatable chamber and at least one valve connecting the second opening to a compressed air source for forcing the compacted deaerated materials from the second rotatable chamber into a receiving container; and an opening in the interior chamber wall of the second rotatable chamber connected to the second opening in the housing for injecting compressed air into the second rotatable chamber.

19. The vacuum fill system for deaerating flowable materials of claim 18, wherein the fixed position hollow chamber is positioned between the first rotatable chamber and the second rotatable chamber.

20. The vacuum fill system for deaerating flowable materials of claim 18, wherein the fixed position hollow chamber further comprises a baffle for controlling the flow of the flowable materials into the fixed position chamber from the first rotatable chamber.

* * * * *

UNITED STATES PATENT AND TRADEMARK OFFICE

CERTIFICATE OF CORRECTION

PATENT NO. : 5,244,019

DATED : September 14, 1993

INVENTOR(S) : Norwin C. Derby

It is certified that error appears in the above-indentified patent and that said Letters Patent is hereby corrected as shown below:

On the title page, item [63],

"Continuation-in-part of Ser. No. 643,704, Jan. 22, 1991, abandoned which is a continuation of Ser. No. 407,901, Sept. 15, 1989, abandoned." is deleted and replaced with -- Continuation-in-part of Ser. No. 875,587, April 28, 1992, co-pending, now abandoned which is a file wrapper continuation of Ser. No. 643,704 Jan. 22, 1991, abandoned, which is a continuation of Ser. No. 407,901, Sept. 15, 1989, abandoned. --

Signed and Sealed this

Fifth Day of March, 1996

Bruce Lehman

*Attest:*

BRUCE LEHMAN

*Attesting Officer*

*Commissioner of Patents and Trademarks*